United States Patent [19]

Emmitt

[11] 4,124,122

[45] Nov. 7, 1978

[54] TEST TUBE RACK

[76] Inventor: Ronald W. Emmitt, 28367 Ridgebrook, Farmington, Mich. 48024

[21] Appl. No.: 800,700

[22] Filed: May 26, 1977

Related U.S. Application Data

[63] Continuation of Ser. No. 678,767, Apr. 21, 1976, abandoned.

[51] Int. Cl.[2] ..... B01L 9/06

[52] U.S. Cl. ..... 211/74; 422/104

[58] Field of Search ..... 211/74, 71, 60 R; 23/259, 292

[56] References Cited

U.S. PATENT DOCUMENTS

| | | | |
|---|---|---|---|
| 1,240,520 | 9/1917 | Webb | 211/74 |
| 1,957,263 | 5/1934 | Gray | 211/74 |
| 2,986,039 | 5/1961 | Juodikis | 23/259 X |
| 3,142,385 | 7/1964 | Kahlenberg | 211/74 |
| 3,352,427 | 11/1967 | Lawrence et al. | 211/74 |
| 3,379,315 | 4/1968 | Broadwin | 211/74 X |
| 3,778,232 | 12/1973 | McMorrow, Jr. | 211/74 X |
| 3,843,324 | 10/1974 | Edelman et al. | 23/259 X |
| 3,871,832 | 3/1975 | Le Blanc | 23/292 X |

FOREIGN PATENT DOCUMENTS

| | | | |
|---|---|---|---|
| 224,345 | 11/1924 | United Kingdom | 211/74 |

*Primary Examiner*—Morris O. Wolk
*Assistant Examiner*—Arnold Turk
*Attorney, Agent, or Firm*—Hauke and Patalidis

[57] ABSTRACT

A rack or holder for test tubes and the like comprising a base and at least one test tube support plate member spaced apart from the base substantially parallel thereto and provided with a plurality of regularly arrayed apertures for placement therethrough of the test tubes. The base is provided with apertures each vertically aligned with a corresponding aperture in the support plate members. The apertures in the base or, alternatively, the apertures in the support plate member are each provided with a circular groove in which is disposed a toroidal resilient member, such as an O-ring or the like, having an internal diameter slightly less than the outside diameter of the test tubes. A test tube is normally supported in the rack by being introduced through the aligned apertures of the support plate member and of the base and pushed through the toroidal resilient member. The toroidal resilient member resiliently and frictionally engages the periphery of the test tube and holds it securely in position in the rack. Alternatively, by placing toroidal resilient members in grooves in the apertures in the support plate member, or plate members in arrangement wherein several spaced apart superimposed plate members are used, and by pushing the test tubes only part of the way through the support plate member, there is provided a visual indication of the status of an operation or chemical reaction being effected in the diverse test tubes as a function of the vertical positioning of the test tubes in the rack.

14 Claims, 9 Drawing Figures

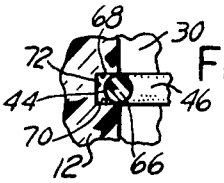
FIG. 6
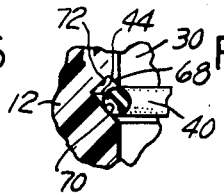
FIG. 8
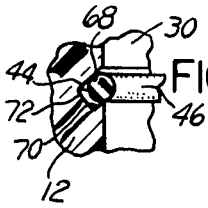
FIG. 7
FIG. 9
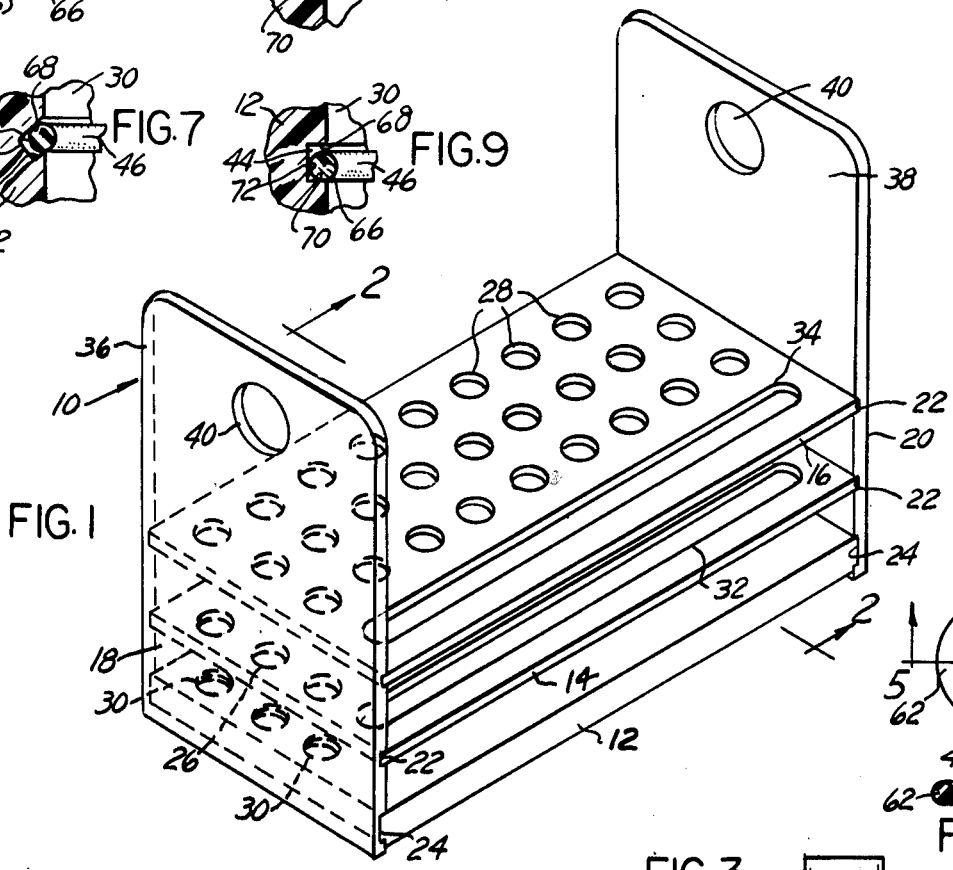
FIG. 1
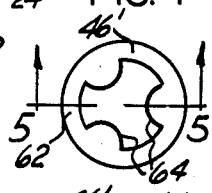
FIG. 4
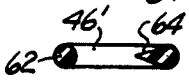
FIG. 5
FIG. 2
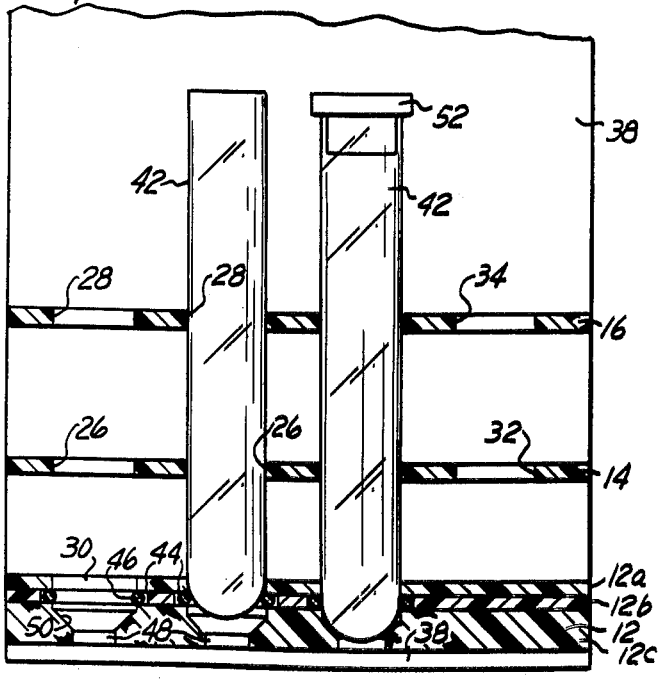
FIG. 3
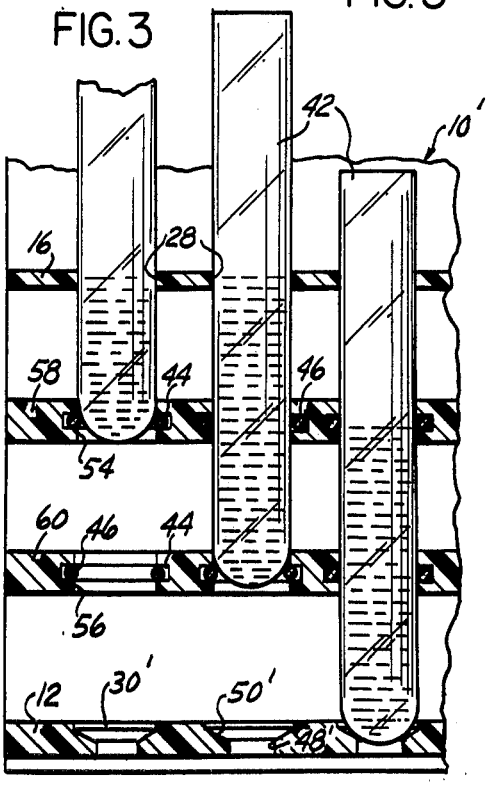

TEST TUBE RACK

This is a continuation of application Ser. No. 678,767, filed Apr. 21, 1976, now abandoned.

BACKGROUND OF THE INVENTION

The present invention relates generally to a rack or holding device for test tubes, such as culture tubes, analysis test tubes and the like, which permits extensive manipulation or transportation of the tubes held in the rack in a safe and secure manner, preventing rattling or dislodging of the tubes from the rack, while still permitting easy manual removal of the tubes from the rack.

In various methods of biological or chemcial analysis and culture testing, extensive handling, manipulation and transportation of rack-held test tubes or culture tubes may take place. It is therefore highly desirable that the test tubes be held securely in position in the holder or rack during manipulation and transportation such that, even though the rack may be upset or upturned, the test tubes do not become dislodged from their position in the rack.

Test tubes or culture tube holders or racks have been designed in the past comprising metallic spring clip means disposed about the apertures in the holder or rack support plate members, as disclosed, for example, in U.S. Pat. Nos. 1,188,146, 3,175,695 and 3,142,385. Such arrangements are generally complex, they provide test tube grasping means engaged only with a portion of the periphery of the tubes, and they may even cause applying too great a pressure on a small area of a relatively fragile tube, thus creating a potentially dangerous situation. U.S. Pat. No. 3,186,556 discloses a test tube rack in which the test tubes are disposed in deeply recessed pockets and held in the pockets by means of a U-shaped metallic spring disposed longitudinally alongside each test tube, and thus does not remedy any of the prior art inconveniences.

The present invention remedies the shortcomings and inconveniences of the prior art by providing a simple rack structure for test tubes and the like consisting of at least a pair of apertured plate members held in spaced parallel relationship and provided with an array of aligned apertures, one plate member, for example the bottom plate member, having each aperture provided with a groove in which is inserted a toroidal elastic element, such as an O-ring, having an internal diameter slightly smaller than the outer diameter of the test tubes, such that when a test tube is pushed through the aperture, it is held in position as a result of its periphery being frictionally and elastically engaged with the inside surface of the O-ring.

Alternatively, the present invention provides a test tube rack adapted to provide to an observer a visual indication of the status of an analysis or other experiment. For that purpose, an embodiment of the present invention contemplates forming a rack with at least a pair of parallel spaced apart apertured plates mounted above a base plate, each of the apertured plates having corresponding arrays of mutually aligned apertures each provided with a groove having a toroidal resilient member disposed therein. In such an arrangement, the depth of penetration of the test tubes within the rack may be manually adjusted such that the status of a manipulation, analysis or experiment may be judged visually as a function of the vertical positioning of the test tubes. In addition, the distance separating the apertured plates may be used as a gage of liquid level in the test tubes, or for any other purpose found suitable.

The many objects and advantages of the present invention will become apparent to those skilled in the art when the following description of the best modes contemplated for practicing the invention is read in conjunction with the accompanying drawing wherein:

BRIEF DESCRIPTION OF THE DRAWING

FIG. 1 is a perspective view of an example of test tube rack according to the present invention;

FIG. 2 is a sectional enlarged view about line 2—2 of FIG. 1;

FIG. 3 is a view similar to FIG. 2 but showing a modification of the invention;

FIG. 4 is a detailed plan view of a toroidal holding member for use in the present invention;

FIG. 5 is a sectional view along line 5—5 of FIG. 4; and

FIGS. 6–9 are schematic partial views of alternative arrangements of the means holding the test tubes in position in a test tube rack according to the present invention.

DETAILED DESCRIPTION OF THE PREFERRED EMBODIMENTS

Referring now to FIG. 1, there is shown a test tube rack 10 according to the present invention comprising a base plate 12 and a pair of spaced apart plates 14 and 16, the plate 14 being disposed between the base plate 12 and the upper plate 16 and being spaced apart from the base plate 12. The plates 12, 14 and 16 are disposed substantially parallel to each other and are held in spacial and parallel relationship by way of a pair of parallelly disposed sidewalls 18 and 20. The plates 12–16 and sidewalls 18 and 20 are preferably made of a plastic material such as an acrylic plastic or the like, and they may be opaque, transparent or colored in any appropriate arrangement or color combinations for the purpose, for example, of distinguishing a rack holding a particular type of test tubes or culture tubes from other racks. The sidewalls 18 and 20 are provided in one side with shallow parallel grooves 22 in which are inserted the ends of the plates 14 and 16, respectively, and with a somewhat wider shallow groove 24, also disposed parallel to the grooves 22, and adapted to receive the end edges of the base plate 12, which in the configuration illustrated is somewhat thicker than the plates 14 and 16. The diverse elements of the plates and of the sidewalls forming the rack 10 are cemented together at their engaged surfaces by way of any appropriate cement or solvent for the particular type of plastic used. It will also be readily apparent that the rack 10 may be constructed of any appropriate material other than plastic, such as stainless steel, aluminum or the like, or it may be constructed of partly plastic and partly metallic materials. The rack 10 can be molded partially or as a whole rather than assembled of united single elements.

Each of the plates 14 and 16 has an array of apertures 26 and 28, respectively, disposed, for example, in regular rows, each row having the same number of apertures. Each aperture 26 of the lower, or intermediary, plate 14 is aligned with a corresponding pair of apertures 26 and 28 in the plates 14 and 16. The plates 14 and 16, in the embodiment shown at FIG. 1, are also provided with mutually aligned cross slots 32 and 34 disposed along a longitudinal edge of each plate and whose principal purpose is to permit to hold a card or any other convenient identification or information displaying member. Preferably, the slots 32 and 34 have a width of an order of magnitude about equal to the diameter of the apertures 28 and 26, such that the slots may be used to hold empty or additional test tubes. The sidewalls 18 and 20 preferably project above the upper plate 16 such as to form both a protecting wall for the test tubes disposed in the rack 10 and a pair of parallel handles 36 and 38 for manually carrying the rack, the handles 36 and 38 being each provided with an opening 40 convenient for projecting therethrough a finger of a hand or, alternatively, for supporting the rack 10 by means of a hanger or the like.

As shown at FIG. 2, the holder or rack 10 of the invention permits to hold a plurality of test tubes 42, or like receptacles, passed through a pair of aligned apertures 28 and 26 of the support plates 16 and 18, the bottom of the test tubes 42 being engaged into the aperture 30 in the base plate 12. Each aperture 30 in the base plate 12 is provided with a circular groove 44 in which is disposed a toroidal resilient member 46, such as, for example, a length of small diameter coil spring with its ends interlocked so as to form the toroidal member or, preferably, an O-ring made of rubber-like material. The aperture 30 may consist simply of a blind recess in the base plate 12 or, preferably and as shown, it may consist of a through opening provided with a reduced diameter portion 48, forming a drain hole. The portion of the aperture 30 adjoining the large diameter portion thereof with the reduced diameter hole 48 forms a tapered surface 50 defining an abutment means engaging the bottom of a test tube 42 passed through the aligned apertures 26 and 28 in the plates and manually pushed down into the aperture 30 in the base plate 12, as illustrated in FIG. 2. It is evident that the inner diameter of the toroidal resilient member 26 is slightly less than the outer diameter of the test tube 42, with the result that when the test tube 42 is inserted through the aligned apertures 28, 26 and 30, with the bottom of the test tube abutting the tapered or frustoconical surface 50, the inner surface of the resilient toroidal member 46 resiliently and frictionally engages a periphery portion of the test tube outer surface, with the result that the test tubes are held securely in the holder or rack 10 when properly inserted therein. In this manner, the rack 10 may be transported around, and even turned upside down, without any risk that the test tubes 42, preferably provided in that case with a stopper 52 if containing a substance, may be upset or caused to fall off the rack.

The base plate 12 may be made of a single, relatively thick sheet of plastic material, or other convenient material, or it may be made of a laminate of three or more sheets, superimposed and cemented together so as to facilitate manufacturing and forming of the groove 44. The first, or upper, sheet 12*a* is made with appropriate apertures of the diameter of the aperture 30, the second sheet 12*b* is made with an aperture corresponding to the larger diameter of the groove 44, and the third sheet 12*c* is made with the taper or frusto-conical surface 50 and the drain hole 48.

As shown at FIG. 3, the present invention contemplates a rack 10', a modification of the structure illustrated at FIGS. 1–2, wherein the base plate 12 is provided with appropriate apertures 30' which may have appropriate toroidal members disposed therein, exactly like the base plate 12 of FIG. 2, but in the alternative may consist simply of a plain pocket preferably with a drain hole 48', as shown. The upper support plate 16, in the arrangement of FIG. 3, has apertures 28 which are aligned with the pocket 30' in the base plate 12 and also with apertures 54 and 56 formed respectively in a pair of intermediary support plates 58 and 60. Each of the apertures 54 and 56 is provided with a circular groove 44 in which is disposed a toroidal resilient member 46 having an internal diameter slightly smaller than the outer diameter of the test tubes 42. In this manner, a test tube 42 may be inserted through an aperture 28 in the upper support plate 16 with its bottom resting against the toroidal resilient member 46, as shown at the left of FIG. 3, or pushed through the toroidal resilient element 46 disposed in the aperture 54 of the support plate member 58, with the end of the test tube abutting against the toroidal resilient member 46 disposed in the circular groove of the aperture 56 in the intermediary support plate 60, as shown in the center of FIG. 3. The test tube 42 may also be pushed all the way into the rack 10' with the end of the test tube abutting against the shoulder surface 50' of the apertures 30' in the bottom plate 12.

The configuration of FIG. 3 not only provides a test tube rack capable of holding securely test tubes when pushed at least through the toroidal resilient member of the upper support plate 58, and a fortiori when the test tube 42 is pushed all the way down with its end abutting the base plate 12, but, in addition, a test tube rack according to the structure illustrated permits to effectuate particular analysis or reaction operations while providing a visual check of the status of the operation. For that purpose, at the beginning of an operation, all the test tubes are placed in the position indicated at FIG. 3 with respect to the left test tube. After a first reactant, for example, has been poured into the test tubes they may then be pushed to an intermediary position, as illustrated at the center of FIG. 3. If a second reactant is added, the test tubes may then be pushed all the way down, with their bottom ends abutting against the base plate 12.

In addition, by having particular distances between the base plate 12, the intermediary plates 60 and 58 and the upper plate 16, corresponding to given graduations of the test tubes or to a given amount of material placed in the test tubes, the rack 10' of the invention may be used as a gage which, in addition to providing a visual indication of the status of an operation or process, permits to judge the quantity of material contained by the test tubes.

It will be appreciated that the hereinbefore given examples of applications of the present invention have been given for illustrative purposes only, and that the structures disclosed should not be limited to the examples of the embodiments shown. It will be readily apparent that in the structure of FIGS. 1–2 more than a pair of support plates 14 and 16 could be used and that in the embodiment of FIG. 3, additional support plates may be provided, with or without restraining elements disposed in the apertures, in the form of the resilient toroidal members.

The resilient toroidal members 46 have been shown as being annular members of circular section. FIGS. 4 and 5 illustrate a variation of annular member 46' having a generally circular section, as shown at 62, and a plurality of integral radially projecting segments 64, directed inwardly. Such an arrangement, as illustrated at FIG. 4, of a modified toroidal member 46', made of an appropriate resilient rubber-like material, permits to accommodate test tubes having slight variations in outer diameter, while still maintaining an appreciable holding pressure upon the peripheral surface of the test tube corresponding to the amount of deformation of the projecting segments 64.

FIG. 6 is an enlarged partial view of the groove 44 with a toroidal resilient member 46 disposed therein between annular parallel sidewalls 68 and 70 of the groove and a bottom cylindrical wall 72. The width of the groove 44 is substantially equal to the circular diameter of the section 66 of the toroidal member 46, the overall diameter of the groove 44 or, in other words, the diameter of groove bottom wall 72 being slightly more than the outer diameter of the toroidal resilient member 46. With the arrangement of FIG. 6, when the test tube is pushed through the aperture, such as aperture 30, in which the resilient toroidal member 46 is disposed in the groove 44, the resilient toroidal member 46 is free to expand radially while being constantly held between the groove parallel sidewalls 68 and 70.

FIG. 7 discloses an arrangement wherein the resilient toroidal member 46 is disposed in a groove 44, having its sidewalls 68 and 70 each disposed about an imaginary conical surface whose apex is directed in a direction opposite to that of introduction of a test tube into the aperture 30, the groove bottom wall 72 being in an imaginary conical surface directed in an opposite direction. As a result of inclining the groove 44 relative to the direction of insertion of the test tube, the toroidal member 46 tends to expand when the test tube is introduced into the aperture 30, with the result that it is relatively easy to introduce a test tube into the aperture. When the test tube is removed from the aperture 30, the toroidal member 46, riding in an opposite direction along the plane of the groove sidewall 68, tends to contract, thus opposing removal of the test tube in such a manner that a greater force must be exerted for removing the test tube than is required for introducing the test tube into the aperture 30.

FIG. 8 illustrates an arrangement opposite to that illustrated at FIG. 7, with the result that a greater force must be exerted on the test tube to introduce it through the aperture 30 than is required for removing the test tube from the aperture.

FIG. 9 illustrates an arrangement similar to that shown at FIG. 6, wherein the sidewalls 68 and 70 of the circular groove 44 are in parallel planes substantially perpendicular to the axis of the test tube being introduced through the aperture 30. However, in the arrangement of FIG. 9, the distance separating the groove sidewalls 68 and 70 is slightly larger than the diameter of the circular section 66 of the toroidal resilient member 46, while the diameter of the groove bottom wall 72 is substantially the same as the outer diameter of the toroidal resilient member 46. When a test tube is introduced into the aperture 30, the toroidal member 46 is prevented from expanding radially because its periphery engages the bottom wall 72 of the groove 44. The resilient toroidal member 46 is, however, caused to be widened at its inner diameter due to the presence of the test tube therethrough, resulting in the circular section 66 of the resilient toroidal member 46 being resiliently deformed to a flattened oval section.

It will be appreciated that any of the groove and toroidal resilient member arrangements of FIGS. 6–9 may be used either in the base plate 12 of the rack of the invention or in any of the support plates disposed above the base plate of the rack.

Having thus described the invention by way of typical structural embodiments thereof, modifications whereof will be apparent to those skilled in the art, what is claimed as new is as follows:

1. A test tube rack for holding test tubes of a predetermined diameter, said rack comprising a plurality of spaced apart superimposed parallel plates comprising at least a top and a bottom plate, each of said plates having an array of apertures each for receiving a test tube, each of said apertures in one plate having a diameter wider than the predetermined diameter of said test tubes and being vertically aligned with a corresponding aperture in each other plate, an annular circular groove formed about the periphery of each of said apertures in at least one plate, a toroidal resilient member in the form of an O-ring made of rubber-like material loosely disposed in said groove, said toroidal resilient member having an internal diameter slightly smaller than the predetermined diameter of said test tubes for peripherally resiliently grasping a test tube inserted through said aperture, and a pair of parallel sidewalls rigidly holding said plates in said superimposed spaced apart relationship.

2. The rack of claim 1 wherein said O-ring has at least a pair of radially projecting integral members.

3. The rack of claim 1 wherein said circular grooves have a bottom wall disposed about a circle of diameter larger than the outside diameter of said toroidal member.

4. The rack of claim 1 wherein said circular grooves have a bottom wall disposed about a circle of diameter substantially equal to the outside diameter of said toroidal member with the width of the grooves being greater than the outside diameter of said toroidal element.

5. The rack of claim 1 wherein said circular grooves and said toroidal members are disposed in said bottom one of said plates.

6. The rack of claim 1 wherein said circular grooves and said toroidal members are disposed in at least one of said plates other than said bottom one of said plates.

7. The rack of claim 1 wherein said grooves have a cylindrical bottom wall and a pair of substantially parallel annular sidewalls, said sidewalls being in planes substantially parallel to an equatorial plane of said toroidal member.

8. The rack of claim 1 wherein said grooves have a cylindrical bottom wall and a pair of substantially parallel annular sidewalls, said sidewalls being obliquely disposed in a downward direction from said cylindrical wall to its respective aperture.

9. The rack of claim 1 wherein said grooves have a cylindrical bottom wall and a pair of substantially parallel annular sidewalls, said sidewalls being obliquely disposed in an upward direction from its respective cylindrical wall to said aperture.

10. The rack of claim 1 further comprising a pair of slots disposed in vertical alignment one in the top one and the other in the next one of said plates substantially parallel to an edge of said plates.

11. The rack of claim 1 wherein each of said sidewalls is provided with a handle.

12. The rack of claim 1 made of a plastic material.

13. The rack of claim 1 further comprising abutment means in the apertures of the bottom one of said plates for engagement with the bottom of said test tubes.

14. The rack of claim 13 wherein said abutment means is in the form of a reduced diameter portion of said apertures in said bottom one of said plates.

* * * * *